US007694469B2

(12) United States Patent
Schultz

(10) Patent No.: US 7,694,469 B2
(45) Date of Patent: Apr. 13, 2010

(54) MUNTIN GRID

(75) Inventor: Steven E. Schultz, Rockford, IL (US)

(73) Assignee: Newell Operating Company, Atlanta, GA (US)

( * ) Notice: Subject to any disclaimer, the term of this patent is extended or adjusted under 35 U.S.C. 154(b) by 1011 days.

(21) Appl. No.: 11/172,107

(22) Filed: Jun. 30, 2005

(65) Prior Publication Data

US 2006/0026914 A1 Feb. 9, 2006

Related U.S. Application Data

(60) Provisional application No. 60/584,874, filed on Jul. 1, 2004.

(51) Int. Cl.
*E06B 3/964* (2006.01)

(52) U.S. Cl. ..... 52/204.61; 52/204.591; 52/311.3; 52/314; 52/656.8

(58) Field of Classification Search ..... 52/314, 52/311.3, 663, 664, 656.8, 204.61, 204.59, 52/844, 855; 403/187, 460, 255, 298; 24/289, 24/292, 297, 293, 275
See application file for complete search history.

(56) References Cited

U.S. PATENT DOCUMENTS 4,530,195 A 7/1985 Leopold
4,546,723 A 10/1985 Leopold et al.
4,628,582 A 12/1986 Leopold
5,099,626 A * 3/1992 Seeger ..... 52/314
5,105,591 A 4/1992 Leopold
5,295,292 A 3/1994 Leopold
5,313,761 A * 5/1994 Leopold ..... 52/786.1
5,361,476 A 11/1994 Leopold
5,657,590 A * 8/1997 Digman et al. ..... 52/204.61
5,678,376 A * 10/1997 Poma ..... 52/656.8
5,678,377 A * 10/1997 Leopold ..... 52/656.9
5,839,713 A * 11/1998 Wright ..... 248/346.01
6,085,481 A * 7/2000 Lee ..... 52/656.8
6,168,459 B1 * 1/2001 Cox et al. ..... 439/495
6,173,484 B1 1/2001 McGlinchy et al.
6,244,012 B1 6/2001 McGlinchy et al.
6,301,843 B1 * 10/2001 Silverman ..... 52/204.5
6,397,453 B1 6/2002 McGlinchy et al.
6,425,221 B1 * 7/2002 Reichert ..... 52/456
6,438,819 B1 * 8/2002 McGlinchy et al. ..... 29/564.6
6,536,182 B2 3/2003 France
6,546,684 B2 * 4/2003 Waalkes et al. ..... 52/239
D478,675 S 8/2003 France
D478,676 S 8/2003 France
D478,677 S 8/2003 France
D478,678 S 8/2003 Hornung et al.
D479,005 S 8/2003 France
D479,006 S 8/2003 Hornung et al.
6,684,474 B2 * 2/2004 Reichert ..... 29/407.05
6,715,244 B2 * 4/2004 Boone et al. ..... 52/204.591

(Continued)

*Primary Examiner*—Brian E Glessner
*Assistant Examiner*—Joshua Ihezie
(74) *Attorney, Agent, or Firm*—Banner & Witcoff, Ltd.

(57) ABSTRACT

A muntin grid (34) is provided having a plurality of muntin bars (36) joined at intersecting points to form a grid (34). The grid (34) further has a plurality of muntin bar ends (38) located near a periphery of the grid (34), each muntin bar end (38) having a depending tab (39). A muntin clip (40) is provided for receiving the tab (39) wherein the tab attaches the clip (40) to the muntin bar end (38).

24 Claims, 8 Drawing Sheets

U.S. PATENT DOCUMENTS

| | | | | |
|---|---|---|---|---|
| 6,868,596 | B2 * | 3/2005 | Reichert | 29/407.05 |
| 7,124,546 | B2 * | 10/2006 | Scharff et al. | 52/314 |
| 2001/0020349 | A1 * | 9/2001 | Richardson | 52/11 |
| 2002/0069823 | A1 | 6/2002 | Briese et al. | |
| 2002/0108228 | A1 | 8/2002 | McGlinchy et al. | |
| 2002/0138964 | A1 | 10/2002 | McGlinchy | |
| 2002/0157769 | A1 | 10/2002 | McGlinchy | |
| 2002/0170159 | A1 * | 11/2002 | McGlinchy et al. | 29/407.01 |
| 2002/0189196 | A1 | 12/2002 | Hornung et al. | |
| 2002/0189743 | A1 | 12/2002 | Hornung et al. | |
| 2003/0084622 | A1 | 5/2003 | Hornung et al. | |
| 2003/0084989 | A1 | 5/2003 | Briese | |
| 2003/0089054 | A1 | 5/2003 | Hornung | |
| 2003/0131558 | A1 * | 7/2003 | France | 52/786.1 |

* cited by examiner

FIG.13
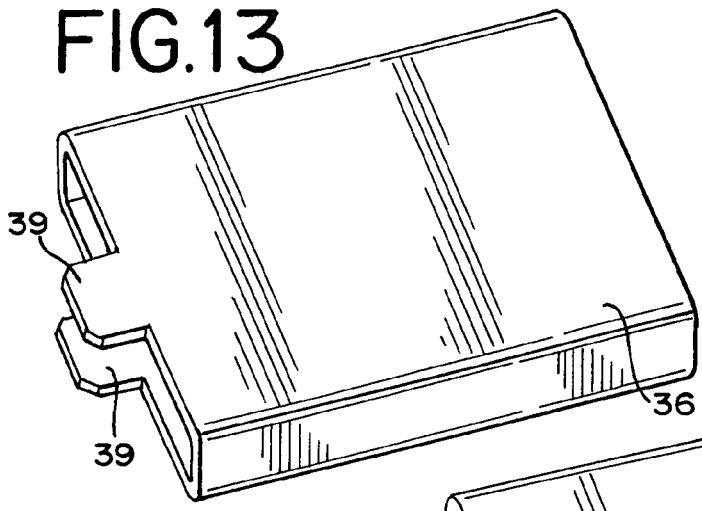
FIG. 14
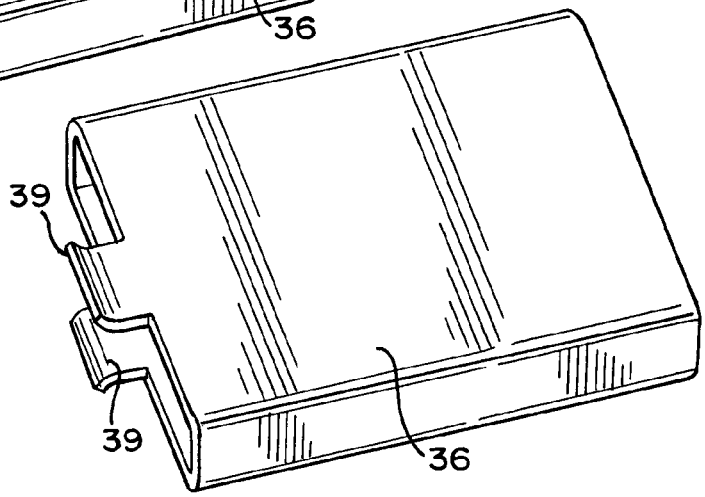
FIG. 15
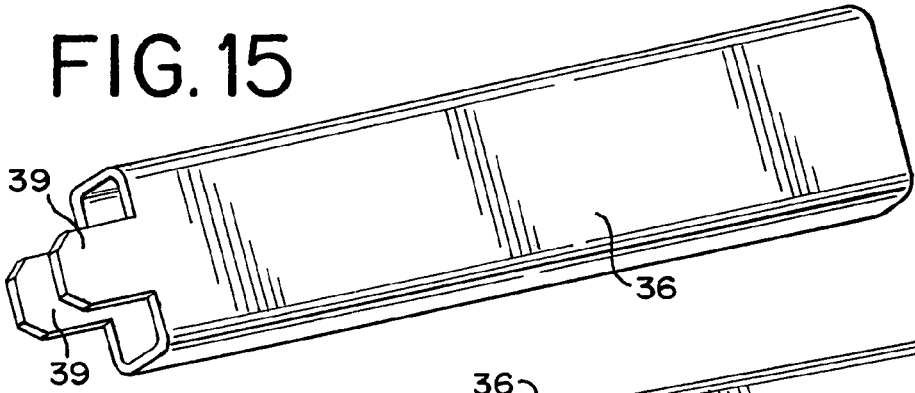
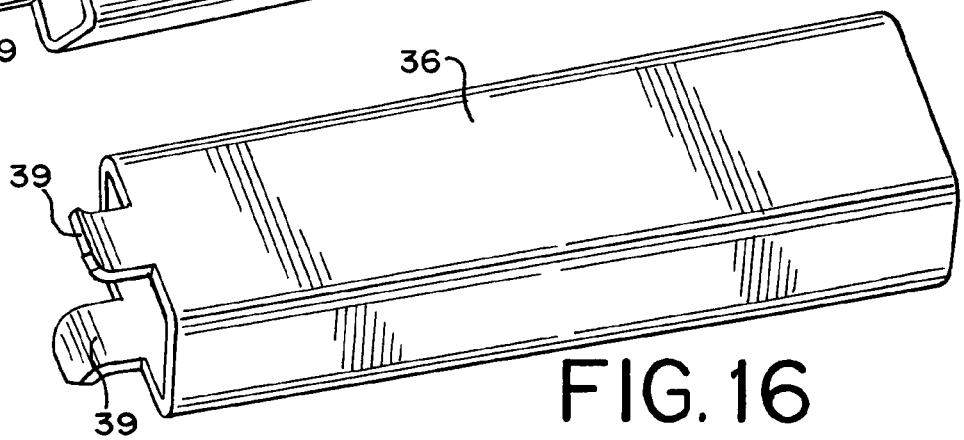
FIG. 16

FIG. 22
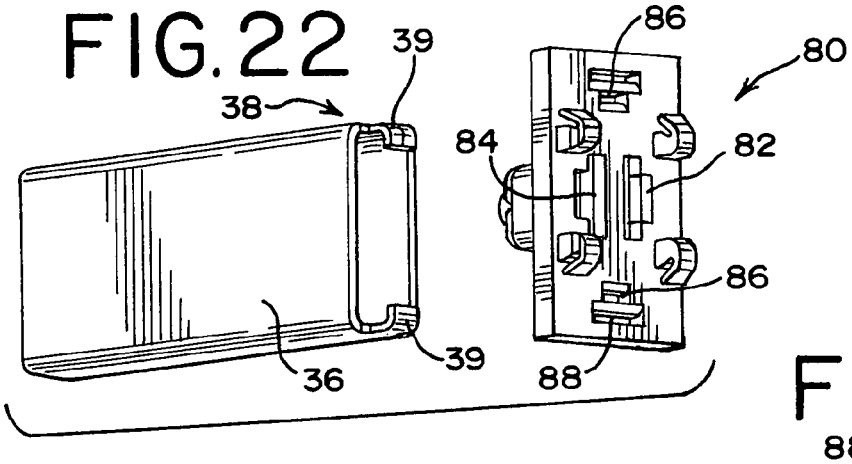
FIG. 23
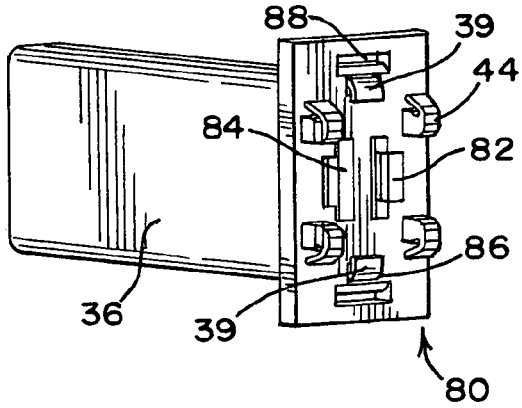
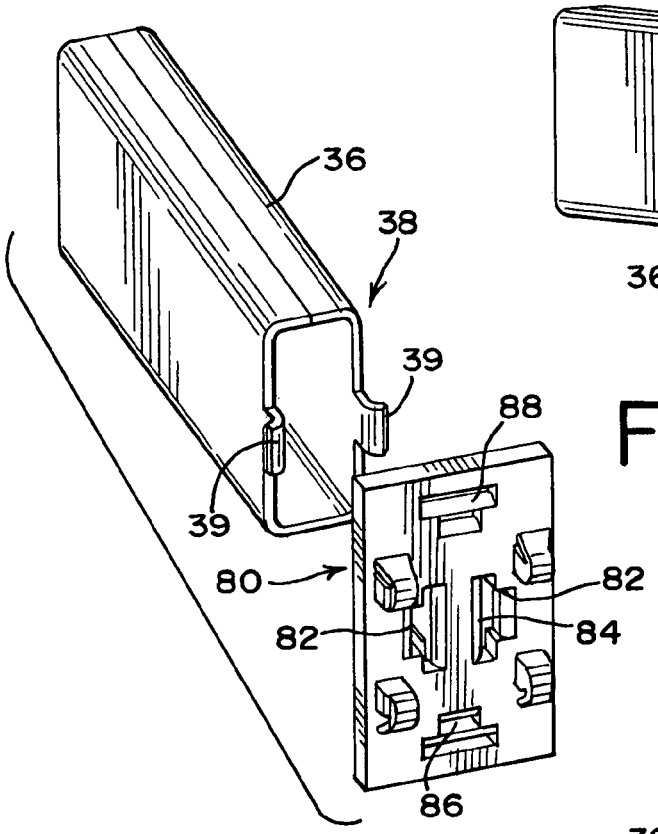
FIG. 24
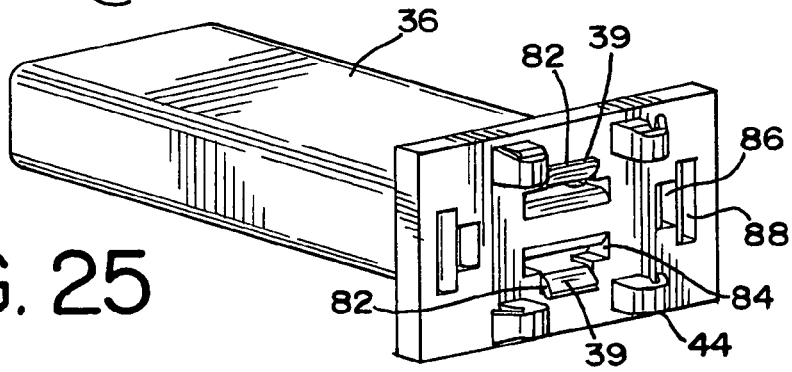
FIG. 25

MUNTIN GRID

CROSS-REFERENCE TO RELATED APPLICATION

This application claims the benefit of U.S. Provisional Application Ser. No. 60/584,874, filed Jul. 1, 2004, which is incorporated by reference herein and made a part hereof.

TECHNICAL FIELD

This invention relates generally to muntin grids for sash window assemblies and more specifically to a muntin bar and clip assembly and overall system for positioning the grid within a sash window assembly.

BACKGROUND OF THE INVENTION

Double hung window assemblies typically include a pair of sash windows slidably mounted within a master frame. In the past, sash windows were provided with a grid of muntin bars, typically made of wood, that separated and held multiple panes of glass within a sash. Each pane would be mounted within the sash in the same plane. Now, double or multiple pane windows are provided, otherwise known as insulated or thermo-pane window assemblies. These insulated window assemblies include a pair of glass panes mounted in parallel to one another within a sash frame and separated by a small distance. The panes are typically separated by a spacer frame located about a periphery of the panes. Of course, insulated or thermo pane windows are not limited to single or double hung window arrangements. Rather, they have a wide range of applications that are well known in the art. For instance, double pane windows may be incorporated in doors, picture windows, etc.

Grids formed by interconnected muntin bars are often installed between these glass panes of a double pane or insulated sash window. Typically these grids are comprised of multiple muntin bars arranged in a grid pattern and interconnected at interior intersecting points by muntin joiners. The grid is then placed between the panes of glass. The periphery of the grid is then mounted to the sash frame, or more typically, to the spacer frame, by a series of muntin clips. It is understood that the grid can take a variety of different forms.

Typically, the muntin bars are of a tubular or hollow construction and a portion of the clip is received by an end of a muntin bar located at a periphery of the grid. Typically, the hollow muntin bar receives an extension or bar support of the clip that is designed to fit tightly within the hollow muntin bar to effect an interference fit, thereby attaching the muntin clip to the muntin bar end. (See FIG. 5) The clip in turn is attached or connected in some way to the spacer frame. An example of a prior art muntin clip is shown in cross section in FIG. 5. The prior art muntin clip 1 includes a bar support 2, in the form of a tree, tightly fitting within and received by a muntin bar 3.

Muntin grids, including the bars, joiners and clips of which they are comprised, come in numerous shapes and sizes. One drawback resulting from this fact is that muntin clip manufactures must design and produce a separate clip to match each potential size/shape of muntin bar available on the market. A conservative estimate is that there are currently at least 500 muntin clip designs available on the market to accommodate the multitude of sizes and shapes that can be found in the available muntin bars. This costs clip manufacturers, and window manufacturers or assemblers to incur costs associated with maintaining and otherwise dealing with large and varied inventories of muntin clips.

FIGS. 8 and 9 show a spacer frame. The spacer frame typically has a lateral wall having a length C, a pair of vertical walls having a height B, and a pair of shoulders, each having a length X. The shoulders are separated by a distance A. As one might expect, various window designs may and do require variously sized spacer frames. Typically, a manufacturer will adjust the length of the lateral wall C to accommodate window designs having differing widths between their multiple panes of glass. However, for each different value of C (length of lateral or bottom wall), the height B of the vertical wall and the length of the shoulder X remain as constants. Therefore, as the length C of the lateral wall varies between the various required spacer frame designs, the distance A between the shoulders also varies. This distance plays a role in determining what muntin clip may be used with a particular spacer frame.

Accordingly it can be seen that there are at least two factors dictating what type or design of muntin clip may be used in a particular window assembly. First is the configuration of the muntin bar to be used. The second factor is the configuration of the spacer frame. The multitude of variations available in both muntin bars and spacer frames results in the present existence of at least 500 different muntin clip designs currently being available. This in turn causes clip manufacturers and window assembler to be burdened with large clip inventories.

The present invention is provided to solve these and other problems.

SUMMARY OF THE INVENTION

A muntin grid is provided having a plurality of muntin bars joined at intersecting points to form a grid. The grid further has a plurality of muntin bar ends located near a periphery of the grid, each muntin bar end having a depending tab. A muntin clip is provided for receiving the tab wherein the tab attaches the clip to the muntin bar end.

Other features and advantages of the invention will be apparent from the following specification taken in conjunction with the following drawings.

BRIEF DESCRIPTION OF THE DRAWINGS

The invention will now be described by way of example, with reference to the accompanying drawings, in which:

FIG. 13 is a perspective view of an additional embodiment of a muntin bar according to the present invention;

FIG. 14 is a perspective view of the muntin bar of FIG. 13;

FIG. 15 is a perspective view of an additional embodiment of a muntin bar according to the present invention;

FIG. 16 is a perspective view of the muntin bar of FIG. 15;

FIG. 22 is an exploded view of an additional embodiment of a muntin bar and the muntin clip of FIG. 11 according to the present invention;

FIG. 23 is a perspective view of the muntin bar and muntin clip of FIG. 22 connected to each other;

FIG. 24 is an exploded view of an additional embodiment of a muntin bar and the muntin clip of FIG. 11 according to the present invention;

FIG. 25 is a perspective view of the muntin bar and muntin clip of FIG. 24 connected to each other;

DETAILED DESCRIPTION

Figure 1:
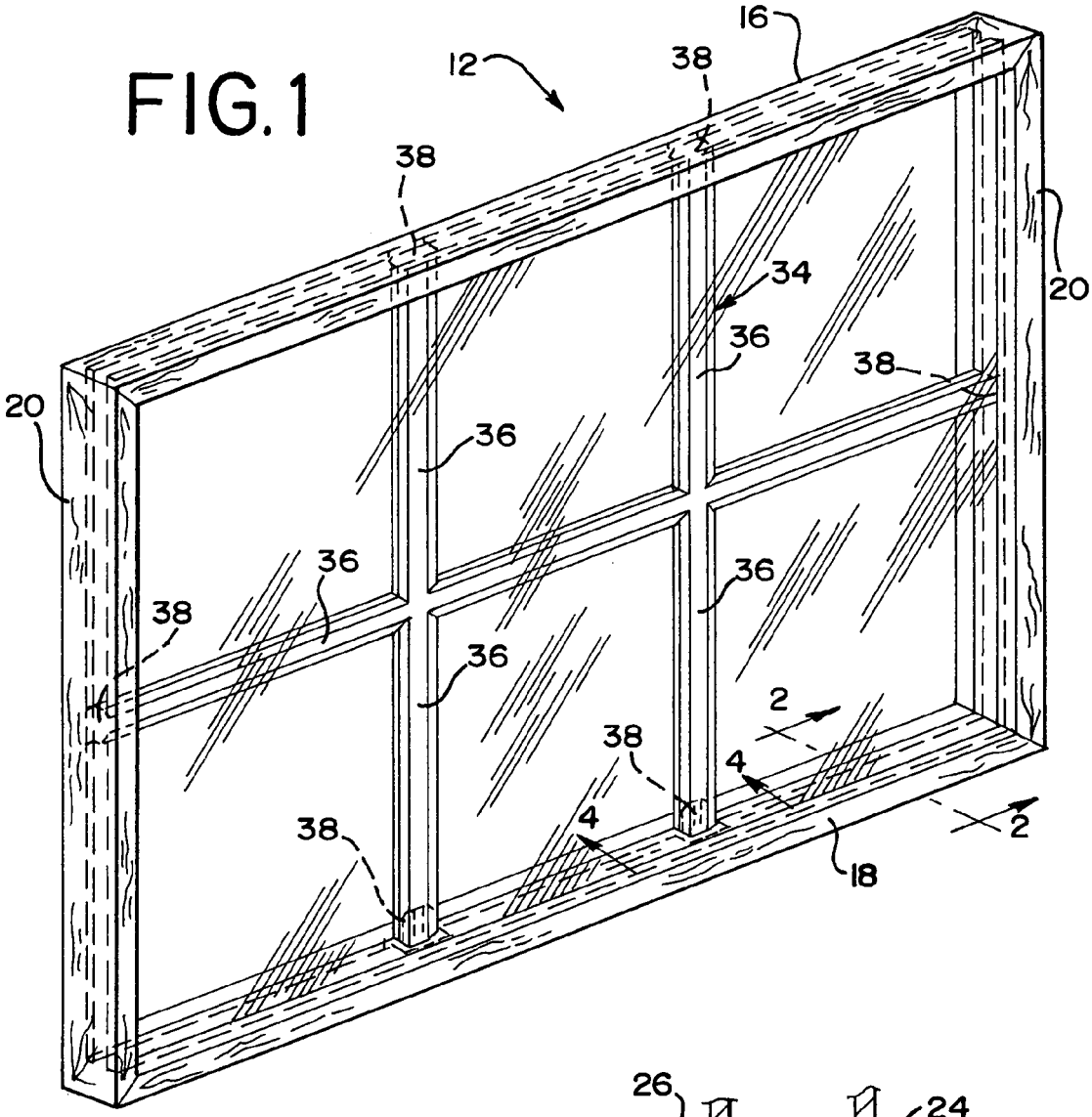
FIG. 1 is a perspective view of a window assembly including a muntin grid.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 shows a sash window 12 comprised of a top sash rail 16, a base sash rail 18 and a pair of vertical stiles 20. Although not shown, the sash window 12 may be mounted, slidingly or otherwise, within a master frame, such as, in a single or double hung window arrangement as is well known in the art.

Figure 2:
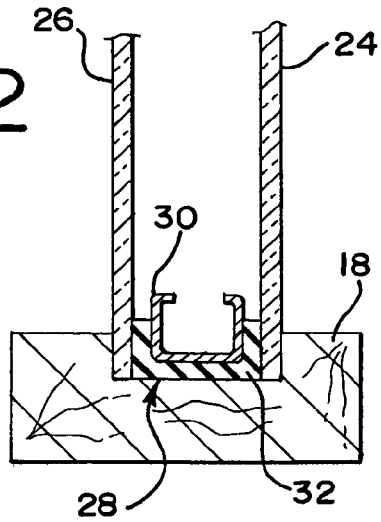
FIG. 2 is a partial cross sectional view of a of the window assembly of FIG. 1 taken along the line 2-2.

As shown in FIG. 2, each sash window 12 also includes a first pane of glass 24 and a second pane of glass 26 mounted in parallel relationship to one another within an interior of the sash window 12. The first and second panes 24, 26 are spaced by a spacer assembly 28 located at a periphery of the panes 24, 26. The spacer assembly 28 comprises a spacer frame 30 and a seal or sealant 32. The spacer frame 30 is generally tubular with a rectangular or square cross section as seen in FIG. 2. The spacer frame 30 extends about the entire periphery of the first and second panes 24, 26. A seal or sealant 32 is applied to an outer region of the spacer frame 30. When pressed between the first and second panes 24, 26, the spacer frame 30 forms an air tight seal between the two panes 24, 26.

A muntin grid 34 is positioned between the first and second panes of glass 24, 26. The muntin grid 34 is comprised of a plurality of interconnecting muntin bars 36. Each muntin bar 36 has a generally tubular and hollow construction. Various means of inter-connecting the muntin bars 36 are known to those of ordinary skill in the art. The connecting means are not further described herein and any means of connecting the muntin bars 36 to one another may be utilized. As can be seen from the figures, the muntin bars 36 are so interconnected to form a grid 34 which is positioned between the first and second panes of glass 24, 26. Extending towards and located at a periphery of the grid 34 are a plurality of muntin bar ends 38. It is understood that the grid 34 can take a variety of forms.

Figure 4:
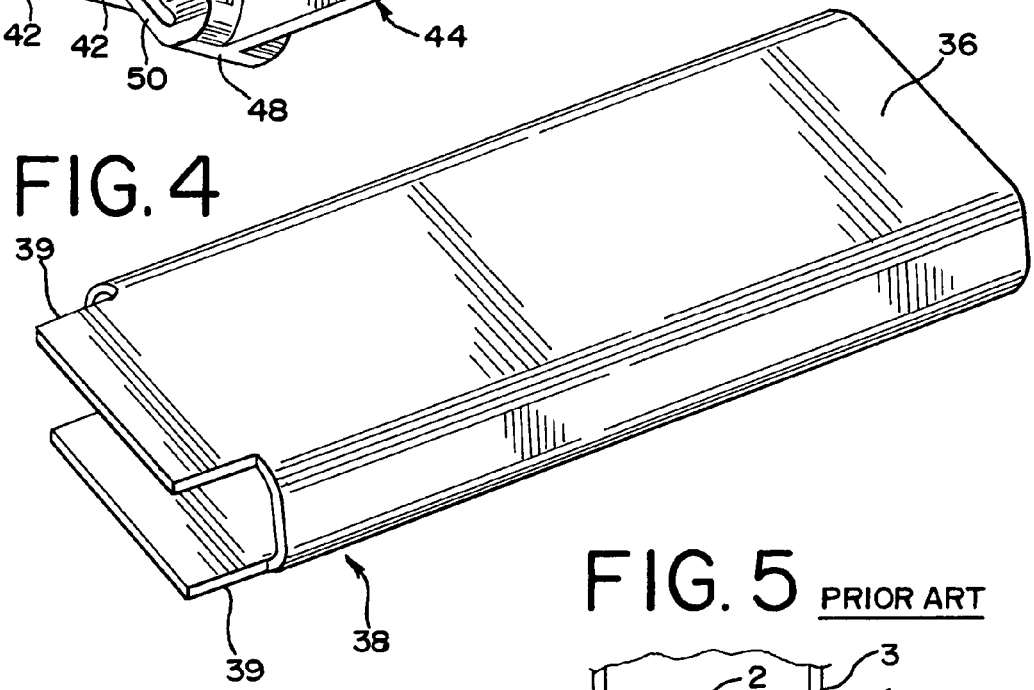
FIG. 4 is a perspective view of a muntin bar according to the present invention.
Figure 5:
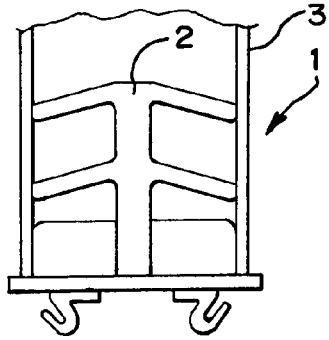
FIG. 5 PRIOR ART
FIG. 5 is a side elevation view of a prior art muntin clip.

A muntin bar 36 according to the present invention is shown in FIG. 4. It can be seen that the muntin bar end 38 includes a pair of depending tabs 39.

Figure 3A:
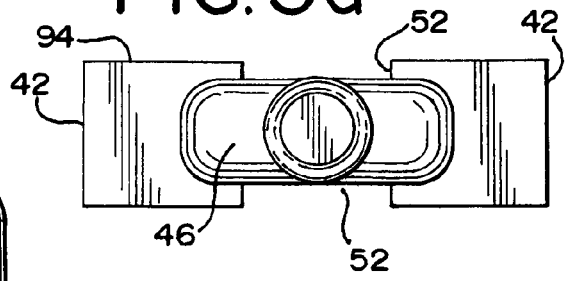
FIG. 3*a* is a top view of the clip of FIG. 3.
Figure 3:
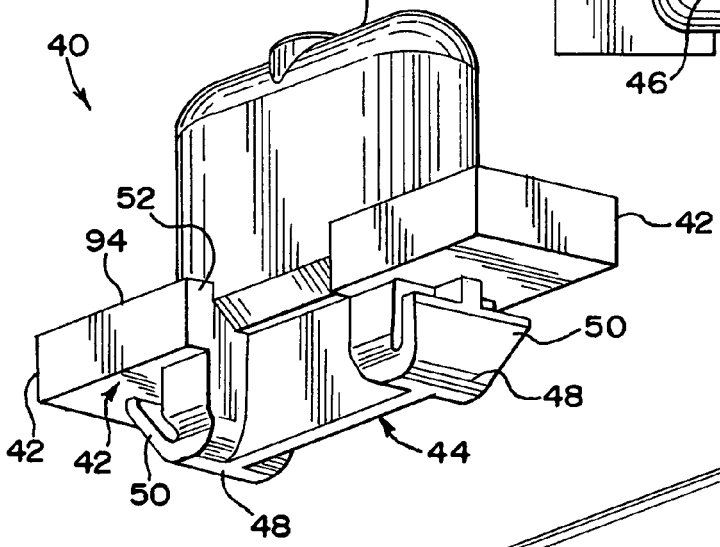
FIG. 3 is a perspective view of a muntin clip according to the present invention.

A muntin clip 40 mounts each muntin bar end 38 to the sash window 12, to be explained. Each muntin clip 36 (FIG. 3) includes a base 42, mount structure 44 and a plug or bar support 46. The mount structure 44 extends from the base 42 in a first direction and is adapted to mount the clip 40 to the spacer frame 30, to be explained. In the embodiment shown in the FIGS., the mount structure 44 includes a pair of latch bodies 48 each having a resiliently flexible latch finger 50 attached thereto.

The bar support 46 extends from the base 42 in a second direction opposite from the first direction in which the mount structure 44 extends from the base 42. The bar support 46 is adapted to fit within and be received by a muntin bar end 38. It is noted that it is not necessary that the bar support 46 fit tightly within the muntin bar end 38. The fit between the bar support 46 and the muntin bar end 38 does not need to be an interference or friction fit according to the present invention. In fact, in many embodiments the support 46 is received by a muntin bar end 38 but does not contact inner surfaces of the bar end 38.

Figure 9:
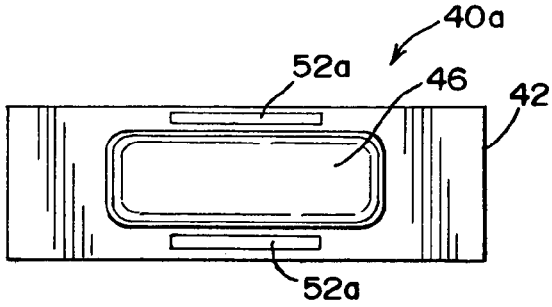
FIG. 9 is a perspective view of an alternative embodiment of a muntin clip according to the present invention.

The base 42, along with both the bar support 46 and mount structure 44, is configured to fit between the first and second pane of glass 24, 26. The base 42 is generally rectangular shaped and includes a pair of slots 52 generally opposed from one another, i.e. located on opposing sides of the bar support 46. In the clip 40 shown in FIGS. 3 and 3*a*, the slots or connection points 52 take the form of opposed indentations or recessed pockets 52 located on opposed edges 94 of the base. Alternately, in the clip 40*a* shown in FIG. 9, the slots 52*a* take the form of passages from the top surface to the bottom surface of the base 42. Similarly, in the clip 80 shown in FIGS. 11-12, the slots 82,84,86,88 also take the form of passages from the top surface to the bottom surface of the base 90. Still further, the clip 40 could be configured to have the slots 52 located elsewhere, for example, in the sides of the bar support 46.

Figure 7:
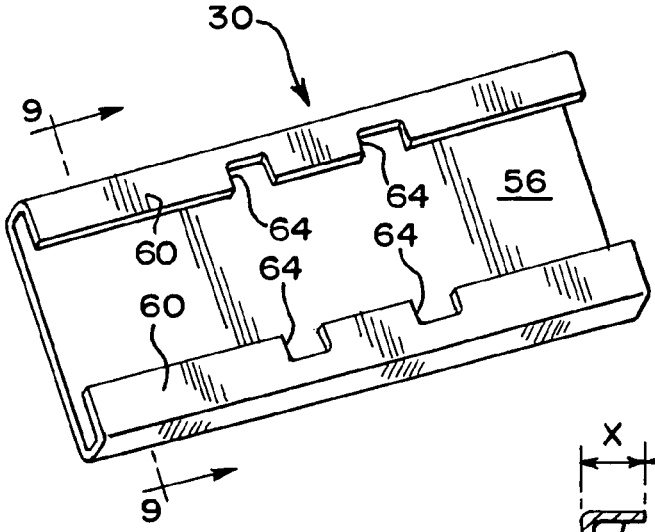
FIG. 7 is a partial isometric view of a spacer frame according to the present invention.
Figure 8:
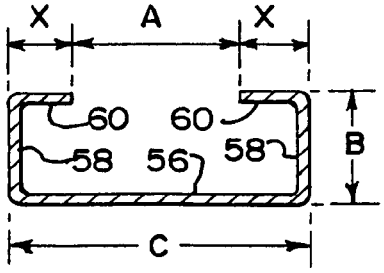
FIG. 8 is a cross section view of the spacer frame of FIG. 8 taken along the line 9-9 of FIG. 7.

FIGS. 7 and 8 depict the spacer frame 30. It can be seen that the spacer frame is generally U-shaped and includes a lateral wall 56 and a pair of vertical walls 58 extending in the same direction from the lateral wall 56. Each lateral wall 56 includes an inwardly extending shoulder 60 located near an end of its respective vertical wall 58 distal from the lateral wall 56. The shoulders 60 are separated by a distance A. The vertical walls 58 each have a height B. The lateral wall 58 has a length C and the shoulders each have a length X. Spaced along a length of an inner edge of the shoulders 60 is a plurality of notches 62 adapted to receive the mount structure 44 of the clips 40, to be explained. It can be seen the each notch 62 on one shoulder 60 is generally opposed from a corresponding notch 62 on the other shoulder 60. The opposed notches 62 form a pair of notches 64. It can also be seen that two notch pairs 64 are usually located in proximity to one another.

To assemble a sash window assembly incorporating a muntin grid 34 utilizing a clip 40 and muntin bar 36 according to the present invention, the spacer assembly 28 is formed according to any method currently known in the art. Then the muntin grid 34 is assembled by joining a plurality of muntin bars 36 to one another to form a grid shape. Typically, the grid is generally rectangular, but it is understood that the grid may take other shapes as well. Then a muntin clip 40 is attached to the grid 34 at each muntin bar end 38 located near a periphery of the overall grid 34.

Figure 6:
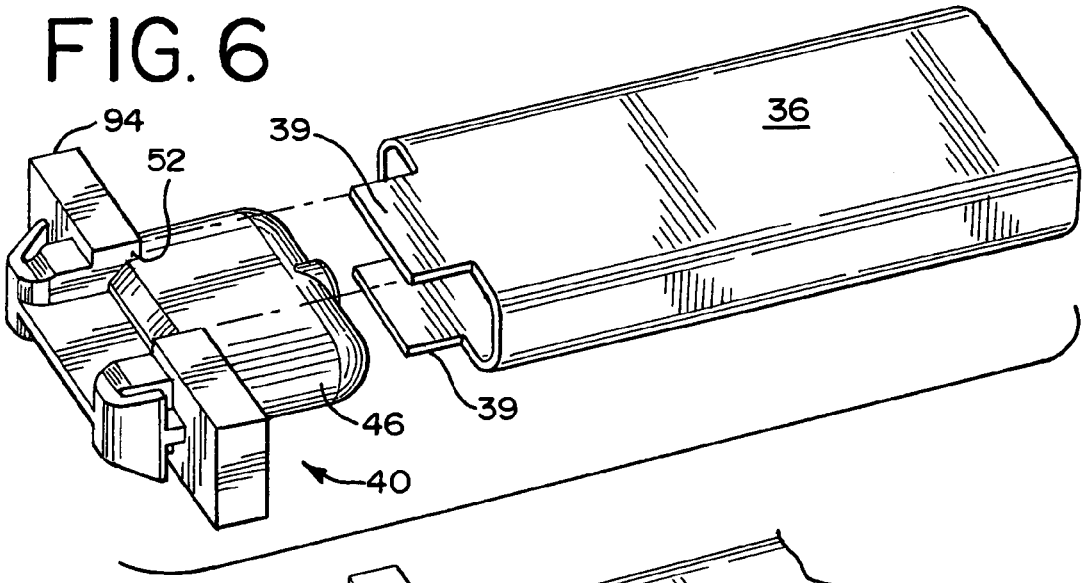
FIG. 6 is an exploded view of the muntin clip of FIG. 3 and the muntin bar of FIG. 4.
Figure 6A:
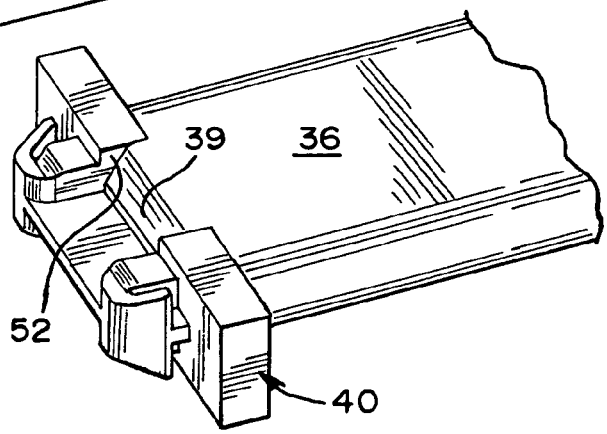
FIG. 6*a* is a partial perspective view of the muntin clip and muntin bar of FIG. 6, showing the muntin bar attached to the muntin clip.

To attach a clip 40 to a muntin bar end 38, the bar support 46 is inserted into the generally hollow muntin bar end 38 such that one depending tab 39 each is received by a respective slot 52 of the base 42 of the clip 40. The tabs 39 are then bent towards one another and into, for example, the indentations 52, to effectively wrap around the base 42 of the clip 40 thereby attaching the clip 40 to the muntin bar 36 and maintaining the bar support 46 within the muntin bar end 38. Thus the tabs 39 generally act as a "staple" to connect the clip 40 to the muntin bar end 38, as illustrated, for example, in FIGS. 6 and 6*a*. Just as the tabs 39 can be bent towards each other (i.e. inwardly), they can also be bent away from each other (i.e. outwardly) to secure the connection between the muntin clip 40 and muntin bar 36. Additionally, in some embodiments, the tabs 39 are bent prior to connection with the muntin bar 36. In this case, the tabs 39 preferably have sufficient flexibility and resilience to allow the muntin bar 36 to be simply snapped into place without affecting the ability of the tabs 39 to secure the connection. In other embodiments, the tabs 39 are bent after connection with the muntin bar 36. As described above, the tabs 39 are preferably bent by a pinch roller, but may also be bent by any other suitable means, including by hand. In any case, the tabs 39 act very similar to a standard staple. Furthermore, it may be that the clip 40 does not contain slots 52. So long as the tabs 39 and clip 40 are adapted such that bending or other forming of the tabs 39 act to interfere with the clip 40 secure the clip 40 to the bar 36, the invention is being practiced.

It should be noted that the process of attaching a muntin clip 40 to a muntin bar end 38 may be fully automated and performed entirely by machinery. Also, the overall process of assembling a muntin grid 34 may also be fully automated, to be discussed.

Once a muntin clip 40 is attached to each muntin bar end 38, the overall muntin grid 34 may be attached to the spacer frame 30. This is accomplished by orienting the overall grid 34 such that each muntin clip 40 attached to the grid 34 is located near one set of two notch pairs 64. The clip 40 is then inserted into the spacer frame 30 such that one notch pair 64 each receives one latch body 48 of the clip 40. That is, one latch body 48 spans the distance A of the spacer frame 30 and is received by each notch 62 of a notch pair 64. A portion of the spacer frame shoulder 60 is received between a latch finger 50 and the base 42 of the clip 40. Once each of the muntin clips 40 of each muntin bar end 38 is attached to the spacer frame 30 in this manner, the over all grid 34 is positioned within the plane defined by the spacer frame 30. The panes 24, 26 may be assembled to the spacer frame assembly 28, which in turn may be installed into a sash window 12 in any known manner.

As can be seen by the above, according to the invention, the muntin clip 40 may be utilized with a variety of muntin bar 36 designs. So long as the plug or support 46 may fit within the muntin bar end 38, even very loosely, and so long as the muntin bar tabs 39 are adapted to be formed or bent to attach the clip 40 to the bar 36, the particular clip 40 may be used with that bar. Accordingly and unlike with previously known clips, one clip 40 according to the present invention may be used with any number of muntin bar 36 designs.

It is also envisioned by the present invention that a single muntin clip 40 may be used with a variety of spacer frame 30 configurations, according to the following. As noted, known spacer frame manufactures generally manufacture a range of spacer frame designs. For the purpose of the present description, we will refer to a range R. Within any range R of designs, manufacturers will vary what may be termed the overall width of the spacer frame. This width is the length C as depicted in FIG. 8. As also noted, the manufacturers will keep the height B of the side walls and the length X of the shoulder as constants, therefore varying the width of the space A between shoulders, for each spacer frame having a different width within the range R. In other words, each spacer frame 30 within a particular range R has its own value of A, or width between the shoulders.

As described, to attach a clip 40 to a spacer frame 30, each latch body 48 must span the width A to be received by a pair of opposed notches 64. Therefore, each spacer frame 30 within the range R requires a different latch body 48 design (length). This fact contributes to the large number of clip 40 designs currently required by the industry.

According to the present invention, spacer frames 30 are manufactured within any given range R of overall spacer frame widths such that the values of B (overall height) and A (space between shoulders 60) remain constant. Of course then, to keep A as a constant, the length X of the shoulders 60 will vary, according to the present invention, as the overall width C is varied.

There may be on average, perhaps 5 spacer frame widths within any given range R. This then results in reducing the number of required muntin clips 40 potentially usable with that range of spacer frames by a factor of 5. This fact coupled with the reduction of muntin clips 40 realized by the above improved muntin bar 36/clip 40 connection results in a substantial and much needed reduction in the overall required amount of muntin clip 40 designs.

Yet another embodiment of the invention is envisioned wherein the muntin bar end 38 has no tabs 39. Rather, once the plug or bar support 46 is inserted into the muntin bar 36, the end 38 of the bar 36 is suitably compressed to hold the bar support 46 within the muntin bar end 38.

It should further be noted, that it is not necessary that the mount structure 44 consist of the latch body 48 and latch finger 50 described above. Rather any means of attaching the clip 40 to the spacer frame 30 may be utilized.

Figure 10:
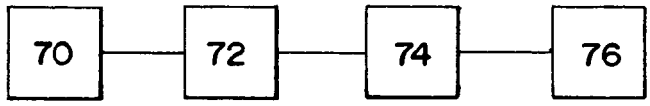
FIG. 10 is a schematic of an automatic assembly process.
Figure 26:
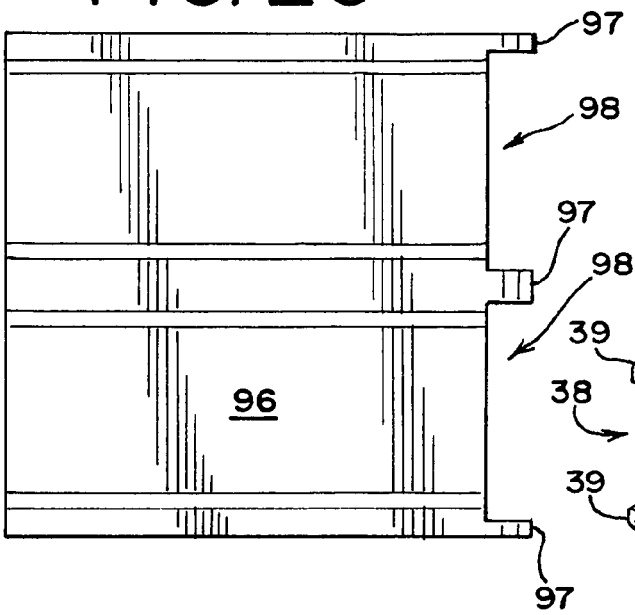
FIG. 26 is a plan view of an embodiment of a metal piece used to form a muntin bar according to the present invention.
Figure 27:
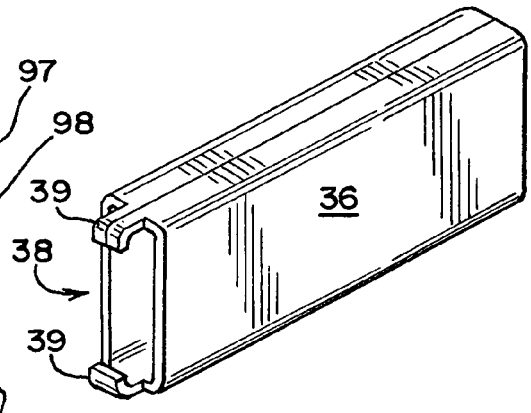
FIG. 27 is a perspective view of a muntin bar formed by the metal piece of FIG. 26.
Figure 29:
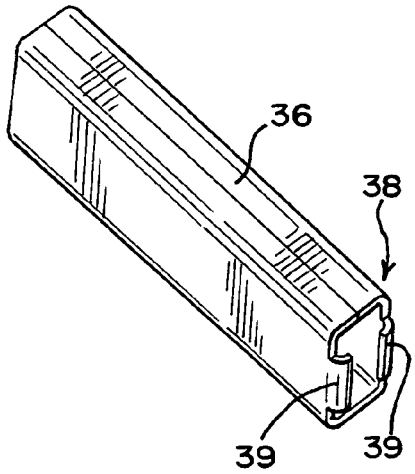
FIG. 29 is a perspective view of a muntin bar formed by the metal piece of FIG. 28.
Figure 28:
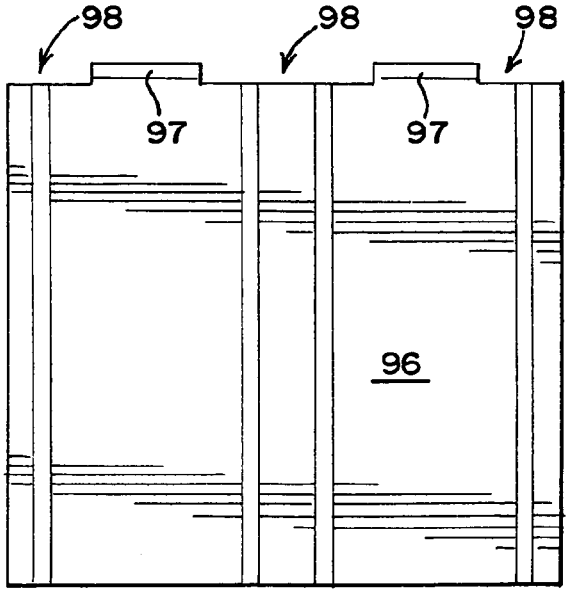
FIG. 28 is a plan view of another embodiment of a metal piece used to form a muntin bar according to the present invention.

It should further be noted that the overall assembly process may be automated according to the following description of the schematic of FIG. 10. At a stage 70, the muntin bars 36 are formed. The bars 36 are formed in a punching and rolling process. The bars 36 are typically formed form 2100 spec. sheet aluminum. At one point of stage 70, the individual bars 36 are punched from the aluminum sheet including the depending tabs 39. The punching step creates a substantially rectangular piece 96 of metal sheet, as shown in FIGS. 26 and 28. Portions of an edge 98 of the piece 96 are removed to create extensions 97, and this step can be performed by the punching step or subsequent to the punching step. In FIG. 28, the piece 96 has two extensions 97 and in FIG. 26, the piece 96 has three extensions 97. At another point of stage 70, the punched pieces 96, still in sheet form, are rolled to form the generally cylindrical, tubular hollow bars 36. Upon rolling, the extensions 97 form the tabs 39 on the end of the bar 36. In the bar 36 shown in FIGS. 28-29, each of the two extensions 97 forms a separate tab 39 on the bar 36. In the bar 36 shown in FIGS. 26-27, the middle extension 97 forms one of the tabs 39 and the two outer extensions 97 combine to form the other tab 39.

At stage 72, the overall muntin grid 34 may be assembled by interconnecting various previously formed muntin bars 36. Either before or after a stage 72, at stage 74, the appropriate muntin clip 40 for the particular overall window design is inserted into the muntin bar 36 such the bar support 46 is received by the appropriate muntin bar end 38 and the tabs 39 are received by the slots 52. At a stage 76, rollers or other means are used to press the tabs 39 together thereby connecting the clip 40 to the bar 36. For example, another means to press the tabs 39 together is by hand. At a stage 78, the muntin grid 34 with clips 40 is connected to the previously formed spacer frame 30. It should be noted that each of the clip 40 embodiments described above could be incorporated in a similar automated assembly process. Variations in the process could include rollers or other means to bend the tabs 39 away from each other or apart. Or the tabs 39 could be pushed against a plate with generally U-shaped slots or grooves causing them to bend in a manner similar to most desk top staplers. It is further understood that appropriate modules can be set in place for transporting, holding and manipulating the muntin bars 36 and muntin clips 40 to achieve the desired attachment via an automated process. It is also understood that depending on the muntin clip embodiment utilized, the tabs 39 of the muntin bar 36 will preferably either be deformed into the muntin clip indentations 52 or inserted into the slots 84,82, 86,88 wherein the tabs 39 can be bent for securing to the clip 40,80.

With the muntin clip 40 and muntin bar 36 designs as described above, the number of differently-sized muntin clips 40 can be drastically reduced. In addition, the number of spacer frame assemblies can be reduced.

FIGS. 11-21 show additional embodiments of both muntin clips 40 and muntin bars 36.

Figure 11:
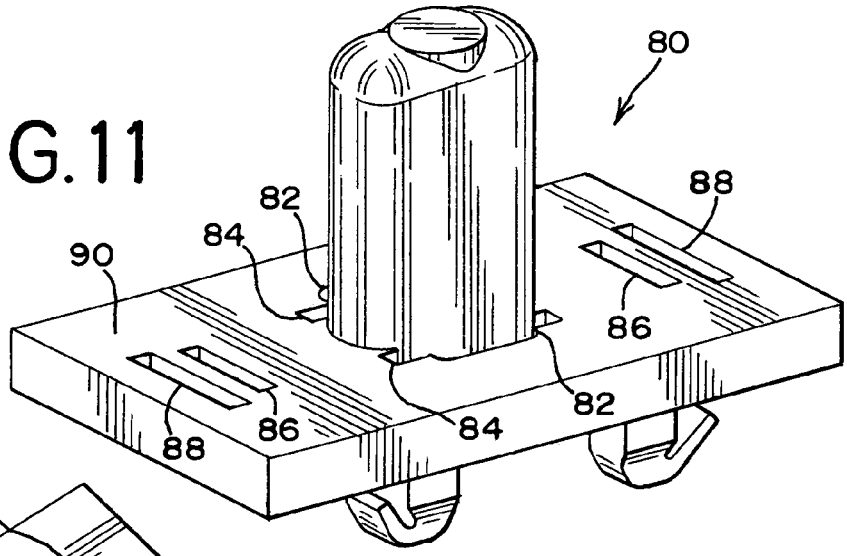
FIG. 11 is a perspective view of an additional embodiment of a muntin clip according to the present invention.
Figure 12:
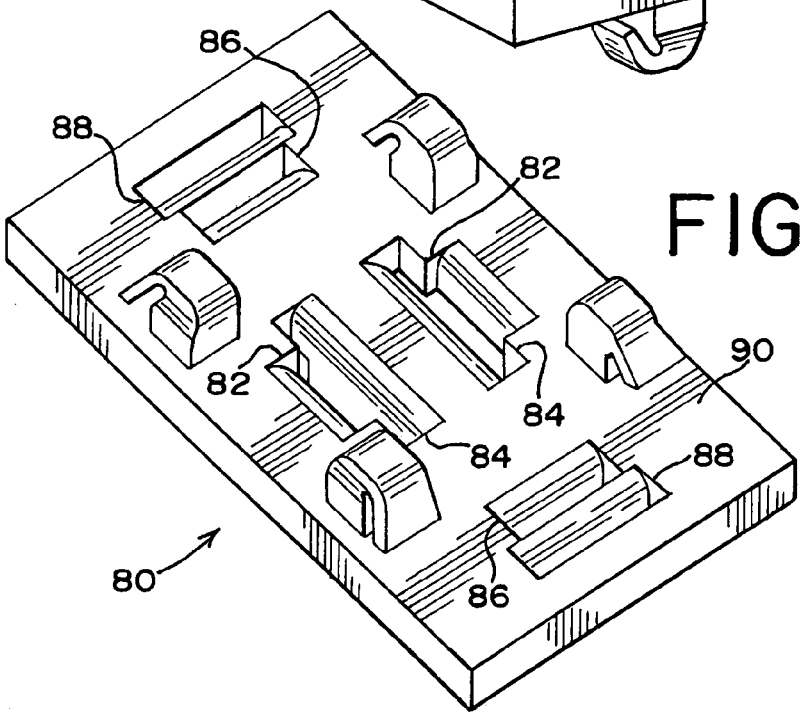
FIG. 12 is a perspective view of the underside of the clip of FIG. 11.

FIGS. 11 and 12 show an additional embodiment of a muntin clip 80. The clip 80 includes a base 90 having four sets of slots for receiving muntin bar tabs 39 and a mount structure 44. The first set 84 is a lateral slot located close to a bar support 92. The second set of slots 82 is also a lateral slot located next to the first set 84. The first set 84 is wider than the second set 82. Obviously they are designed to accommodate tabs 39 of differing widths. Additional slots could be added.

The third set of slots 86 and is an end slot. The fourth set of slots 88 is also an end slot and is located in proximity to the third set of slots 86. Obviously, the forth slot 88 is designed to accommodate and receive a wider set of tabs 39 than is the third set of slots 86. FIG. 12 shows the under side of the clip 80 to better show each set of slots 82, 84, 86 and 88.

Each set of slots 84,82,86,88 in the muntin clip 80 forms a connection point for a muntin bar 36 having a specified width. Thus, the muntin clip 80 shown in FIGS. 11-12 contain a plurality of connection points, each adapted to be connected to a different configuration of muntin bar 36. Several of these configurations are described below, which list is not exclusive or exhaustive. In each of these configurations, the width of the muntin bar 36, measured proximate the tabs 39 is substantially equal to the distance between the set of slots 84,82,86, 88 to which the bar 36 is adapted for connection. Additionally, as described above, the muntin clip 80 may function suitably without slots 84,82,86,88, and thus, the connection point may take another form. Thus, any feature of the muntin clip 80 adapted for connection to a muntin bar 36 may be referred to as a connection point.

FIGS. 13 and 14 show a muntin bar 36 having tabs 39 adapted to be received by either the first or second set of slots 82, 84. FIG. 14 shows the position of the tabs 39 after they have been bent after being received by the appropriate set of slots 82, 84. (Of course, the clip 80 is not actually shown in FIG. 14 to allow each tab 39 to be seen in its bent/assembled position.)

FIGS. 15 and 16 show a muntin bar 36 having tabs 39 adapted to be received by either the first or second set of slots 82, 84. FIG. 16 shows the position of the tabs 39 after they have been bent after being received by the appropriate set of slots 82, 84. (Of course, the clip 80 is not actually shown in FIG. 16 to allow each tab 39 to be seen in its bent/assembled position.)

Figure 17:
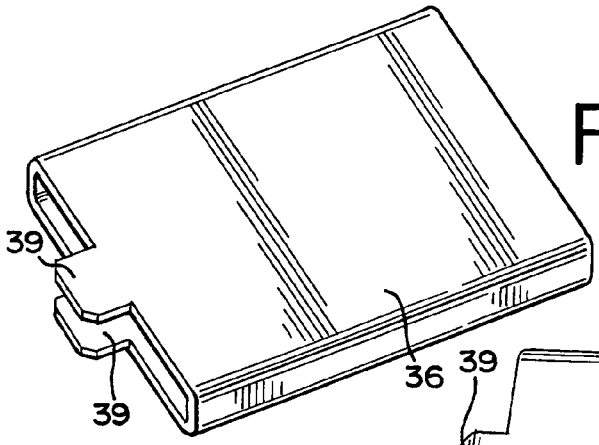
FIG. 17 is a perspective view of an additional embodiment of a muntin bar according to the present invention.
Figure 18:
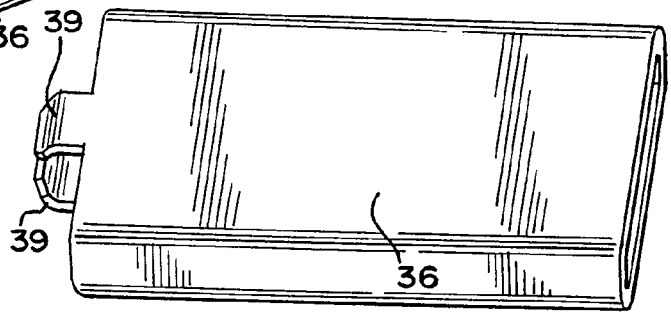
FIG. 18 is a perspective view of the muntin bar of FIG. 17.

FIGS. 17 and 18 show a muntin bar 36 having tabs 39 adapted to be received by either the first or second set of slots 82, 84. FIG. 18 shows the position of the tabs 39 after they have been bent after being received by the appropriate set of slots 82, 84. (Of course, the clip 80 is not actually shown in FIG. 18 to allow each tab 39 to be seen in its bent/assembled position.)

Figure 19:
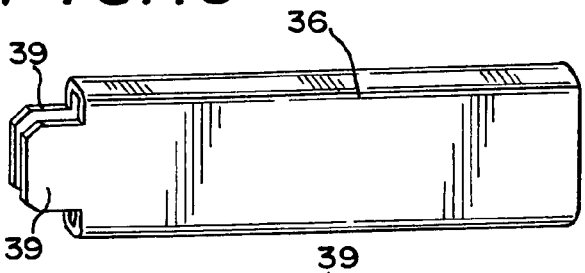
FIG. 19 is a perspective view of an additional muntin bar according to the invention.
Figure 20:
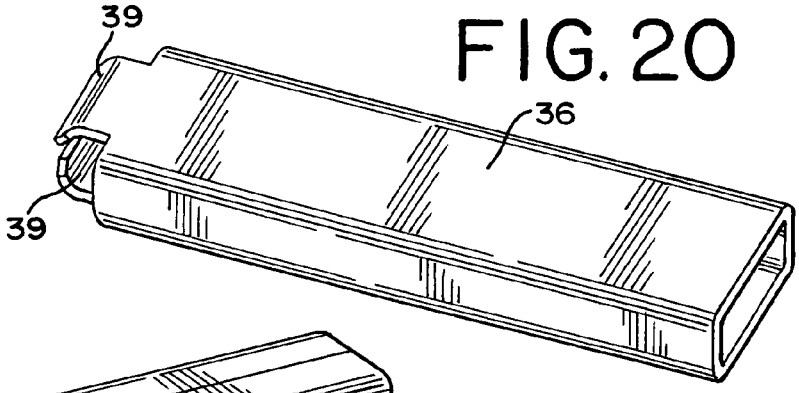
FIG. 20 is a perspective view of the muntin bar of FIG. 19.

FIGS. 19 and 20 show a muntin bar 36 having tabs 39 adapted to be received by either the first or second set of slots 82, 84. FIG. 20 shows the position of the tabs 39 after they have been bent after being received by the appropriate set of slots 82, 84. (Of course, the clip 80 is not actually shown in FIG. 20 to allow each tab 39 to be seen in its bent/assembled position.)

Figure 21:
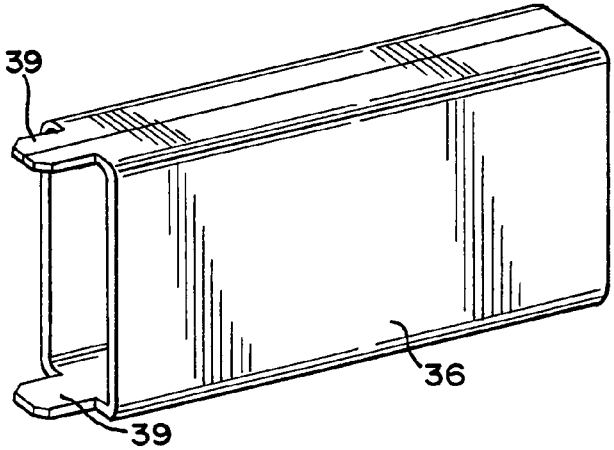
FIG. 21 is a perspective view of an additional embodiment of a muntin bar according to the present invention and adapted for use with the muntin clip of FIG. 20.

FIG. 21 shows a muntin bar 36 having end tabs 39 adapted to be received by either the third or forth sets of slots 86, 88. Similar to the previous embodiments, when the tabs 39 of FIG. 21 are received by the appropriate set of slots of the third set 86 or forth set 88, they are bent either towards each other or away from each other to attach the clip 80 to the bar 36.

FIGS. 22 and 23 illustrate one embodiment of the connection between the muntin clip 80 and a muntin bar 36. The muntin bar 36 in FIGS. 22 and 23 has end tabs 39 that are bent inwardly prior to connection to the muntin clip 80. These end tabs 39 are adapted to be received by the third set of slots 86 of the muntin clip 80, as shown in FIG. 23. Alternately, the end tabs 39 could be bent outwardly prior to connection, or could be bent inwardly or outwardly after connection. However, due to the arrangement of the third and fourth sets of slots 86,88 in the muntin clip 80, it is preferable that the tabs 39 are bent inwardly. It is understood that the tabs 39 could remain straight when inserted into the slots 86 and then bent or deformed to be secured.

FIGS. 24 and 25 illustrate another embodiment of the connection between the muntin clip 80 and a muntin bar 36. The muntin bar 36 in FIGS. 24 and 25 has tabs 39 that are bent outwardly prior to connection to the muntin clip 80. The tabs 39 are adapted to be received by the second set of slots 82 of the muntin clip 80, as shown in FIG. 25. Alternately, the tabs 39 could be bent inwardly prior to connection, or could be bent inwardly or outwardly after connection. However, due to the arrangement of the first and second sets of slots 84,82 in the muntin clip 80, it is preferable that the tabs 39 are bent outwardly.

It is noted that in any embodiment discussed above, or combination thereof, it does not matter if the tabs are bent towards each other, or away from each other so long as after bending, the bent tab 39 interferes with the base 42 to hold the clip within the muntin bar end 38. Additionally, it may be that the bar has a single depending tab 39 that may be bent to connect the clip to the muntin bar. Other interfering connections are also possible, such as the use of other forms of resilient tabs with cooperative structure on the clip, or interference fits between the tabs and slots.

While the specific embodiments and various details thereof have been illustrated and described, numerous modifications come to mind without significantly departing from the spirit of the invention and the scope of protection is only limited by the following claims.

What is claimed is:

1. A window muntin clip comprising:

a base having first and second opposed surfaces;

a mount structure having a plurality of flexible latch fingers extending from the first surface of the base and adapted for connection to a spacer frame;

a bar support extending from the second surface of the base, the bar support adapted to be received by a muntin bar end; and a first slot and a second slot positioned through the base on opposing sides of the bar support, the first slot and second slot being unobstructed when the bar support extends directly from and is in contact with the second surface of the base.

2. The window muntin clip of claim 1, wherein the first slot and second slot are located on the base and extend from the first surface to the second surface of the base.

3. The window muntin clip of claim 1, wherein the first slot and the second slot are each adapted to receive a portion of the muntin bar end.

4. The window muntin clip of claim 3, wherein the muntin bar end comprises a first tab and a second tab, the first slot adapted to receive the first tab and the second slot adapted to receive the second tab.

5. The window muntin clip of claim 1, wherein the first slot comprises a passage extending from the first surface of the base to the second surface of the base.

6. The window muntin clip of claim 1, wherein the first slot comprises a first indentation located on a first edge of the base and the second slot comprises a second indentation located on a second edge of the base.

7. The window muntin clip of claim 1, further comprising a third slot and a fourth slot positioned on opposing sides of the bar support.

8. The window muntin clip of claim 7, wherein the third slot and the fourth slot are each adapted to receive a portion of the muntin bar end.

9. The window muntin clip of claim 7, further comprising a fifth slot and a sixth slot positioned on opposing sides of the bar support.

10. The window muntin clip of claim 9, wherein the fifth slot and the sixth slot are each adapted to receive a portion of the muntin bar end.

11. The window muntin clip of claim 9, further comprising a seventh slot and an eighth slot positioned on opposing sides of the bar support.

12. The window muntin clip of claim 11, wherein the seventh slot and the eighth slot are each adapted to receive a portion of the muntin bar end.

13. The window muntin clip of claim 1, wherein the mount structure comprises a pair of latch bodies, each having a resiliently flexible latch finger attached thereto.

14. A window muntin clip comprising:

a base having first and second opposed surfaces;

a mount structure having a plurality of flexible latch fingers extending from the first surface of the base and adapted for connection to a spacer frame;

a bar support extending from the second surface of the base, the bar support adapted to be received by a window muntin bar end;

a first pair of opposed slots extending from the first surface of the base to the second surface of the base and separated by a first distance, each adapted to receive a portion of a window muntin bar end having a width substantially equal to the first distance; and a second pair of opposed slots extending from the first surface of the base to the second surface of the base and separated by a second distance, each adapted to receive a portion of a window muntin bar end having a width substantially equal to the second distance, wherein the first pair of opposed slots and the second pair of opposed slots are unobstructed when the bar support extends directly from and is in contact with the second surface of the base.

15. The window muntin clip of claim 14, further comprising a third pair of opposed slots separated by a third distance, each adapted to receive a portion of a window muntin bar end having a width substantially equal to the third distance.

16. The window muntin clip of claim 14, further comprising a fourth pair of opposed slots separated by a fourth distance, each adapted to receive a portion of a window muntin bar end having a width substantially equal to the fourth distance.

17. A muntin bar assembly comprising:

a muntin bar comprising a generally tubular hollow body having a first end and a second end, the first end having a set of opposed tabs thereon, the tabs having a width; and a muntin clip comprising a mount structure adapted for connection to a spacer frame, the muntin clip having a first pair of opposed slots positioned on opposed sides of the bar support, the muntin clip having a second pair of slots positioned on opposed sides of the bar support, wherein the muntin bar is connected to the muntin clip such that the opposed tabs are received by one of the first pair of slots and the second pair of slots, the tabs being bent to interfere with the muntin clip and thereby secure the muntin bar to the muntin clip.

18. The muntin bar assembly of claim 17 wherein the first pair of slots have a first width and the second pair of slots have a second width, the second width being greater than the first width, wherein the opposed tabs of the muntin bar have a width generally corresponding to one of the first width and the second width.

19. The muntin bar assembly of claim 17 wherein each second slot is in communication with a respective first slot wherein the second slots extend beyond the first slots.

20. The muntin bar assembly of claim 19 further comprising a third pair of opposed slots positioned generally transverse to the first pair of slots and being spaced away from the bar support.

21. The muntin bar assembly of claim 20, wherein the muntin bar is connected to the muntin clip such that the opposed tabs are received by one of the first pair of slots, second pair of slots, and the third pair of slots, the tabs being bent to interfere with the muntin clip and thereby secure the muntin bar to the muntin clip.

22. The muntin bar assembly of claim 21, further comprising a fourth pair of opposed slots positioned generally transverse to the first pair of slots and being spaced away from the bar support.

23. The muntin bar assembly of claim 22, wherein the muntin bar is connected to the muntin clip such that the opposed tabs are received by one of the first pair of slots, second pair of slots, third pair of slots, and the fourth pair of slots, the tabs being bent to interfere with the muntin clip and thereby secure the muntin bar to the muntin clip.

24. The muntin bar assembly of claim 23 wherein the fourth pair of opposed slots are spaced away from the bar support a greater distance than the third pair of opposed slots.

* * * * *